US005935045A

United States Patent [19]

Lowe

[11] Patent Number: 5,935,045

[45] Date of Patent: Aug. 10, 1999

[54] PINCER GRASP THERAPY DEVICE

[76] Inventor: Robin J. Lowe, 1416 16th St. South, Great Falls, Mont. 59405

[21] Appl. No.: 08/892,945

[22] Filed: Jul. 15, 1997

[51] Int. Cl.[6] ..... A63B 23/16

[52] U.S. Cl. ..... 482/49; 482/44; 434/258; 601/40; 273/447

[58] Field of Search ..... 482/44, 47, 49, 482/50; 601/40; 273/440, 290, 309, 236, 287, 447; 434/258–260, 200, 345, 333, 334, 403, 429, 247; 206/564; 73/379.02

[56] References Cited

U.S. PATENT DOCUMENTS

| | | | |
|---|---|---|---|
| 121,289 | 11/1871 | Kops . | |
| 935,419 | 9/1909 | Smith | 206/369 |
| 1,007,410 | 10/1911 | Zachariae . | |
| 1,096,616 | 5/1914 | Feuerstein | 206/564 |
| 1,586,111 | 5/1926 | Osborn | 273/148 R |
| 1,678,449 | 7/1928 | Simons | 206/459.5 |
| 1,707,151 | 3/1929 | Thomas . | |
| 2,103,241 | 12/1937 | Bell | 206/564 |
| 2,476,518 | 7/1949 | Underwood . | |
| 3,224,780 | 12/1965 | Mohl | 273/309 |
| 3,916,537 | 11/1975 | Gilligan et al. . | |
| 4,589,549 | 5/1986 | Hehn | 206/387.11 |
| 4,754,963 | 7/1988 | Dowd . | |
| 5,078,387 | 1/1992 | Faust et al. | 482/44 |
| 5,133,544 | 7/1992 | Patik . | |
| 5,147,256 | 9/1992 | Silagy . | |
| 5,156,581 | 10/1992 | Chow . | |
| 5,299,991 | 4/1994 | Sato . | |
| 5,421,732 | 6/1995 | Taylor | 434/200 |
| 5,445,582 | 8/1995 | Brown . | |
| 5,451,191 | 9/1995 | Beenken . | |
| 5,527,240 | 6/1996 | Chen . | |
| 5,527,244 | 6/1996 | Waller . | |

*Primary Examiner*—Jerome W. Donnelly
*Assistant Examiner*—Victor K. Hwang
*Attorney, Agent, or Firm*—Richard C. Litman

[57] ABSTRACT

A pincer grasp therapy device comprises a flat or wedge-shaped board having a groove with compartmentalizing walls and a plurality of grasping pieces in the groove. The groove is deep enough to require careful alignment of fingers used to grasp the grasping pieces in the groove. Variations of the invention are provided for both beginning and advanced pincer grasp therapy. The device is immobilized by use of suction cups on a bottom surface of the device.

13 Claims, 2 Drawing Sheets

PINCER GRASP THERAPY DEVICE

BACKGROUND OF THE INVENTION

1. Field of the Invention

The present invention relates generally to occupational therapy apparatus, and more specifically to apparatus for effective re-development of pincer grasp manipulations of the hand.

2. Description of the Related Art

Hands are delicate, complicated parts of the human body. At the same time, healthy hands are extraordinarily useful, and as a practical matter, healthy hands are indispensable if an individual is to function effectively in modern society. However, physically minor damage to nerves controlling the hands can wreak devastating havoc on the function of the hands. Because such damage is a frequent occurrence, many techniques and devices have been devised for rehabilitating non-functioning or poorly functioning hands. However, no such technique or device, prior to the present invention conveniently provides quick and effective re-development of pincer grasp manipulations that are an essential maneuver accomplished by hands.

U.S. Pat. No. 121,289, issued to Helena P. Debruyn Kops, on Sep. 28, 1871, describes a flat, board-like device having apertures through which fingers of a hand are inserted. The fingers are then flexed, thereby exercising the hand to improve violin-playing. There is no provision in this device for developing control over pincer grasp of grasping pieces.

U.S. Pat. No. 1,007,410, issued to Auguste Zachariae on Oct. 31, 1911, shows a thumb and finger squeezing exerciser, the counter force being provided by a rubber band. No provision for pincer grasp of pieces is taught.

U.S. Pat. No. 1,707,151, issued to David Thomas, on Mar. 26, 1929, describes a finger exerciser having a complicated arrangement of finger-rings, springs, pivoting hinges, and screw-type adjustment members. There is no provision in this labyrinthine device for developing fine control over pincer grasp, or for grasping small objects.

U.S. Pat. No. 2,476,518, issued to Rex Underwood, on Jul. 19, 1949, describes an exercise apparatus having a plurality of finger troughs. Fingers are placed in the troughs to produce stretching of tendons attached to the fingers. There is no provision in this device for developing control over pincer grasp of grasping pieces.

U.S. Pat. No. 3,916,537, issued to Marjorie Crocker Gilligan et al., on Nov. 4, 1975, describes a device for improving a child's dexterity. A clothespin-like member in a puppet body is pressed to enhance finger strength. There is no provision in this device for developing control over pincer grasp of grasping pieces or for aligning fingers in a groove.

U.S. Pat. No. 4,754,963, issued to Michael E. Dowd, on Jul. 5, 1988, describes a hand exercise device. The device of this patent strengthens finger-grip, but does not provide any way for developing control over pincer grasp of grasping pieces or for aligning fingers in a groove.

U.S. Pat. No. 5,133,544, issued to Robert M. Patik, on Jul. 28, 1992, describes an exercise apparatus for exercising the hands. The device is comprised by resilient material having cylindrical holes into which fingers are inserted. The device of this patent strengthens finger-grip, but does not provide any way for developing control over pincer grasp of grasping pieces or for aligning fingers in a groove in which the fingers grasp grasping pieces.

Another hand-squeezing device, the counter force being provided by a plurality of springs, is taught by U.S. Pat. No. 5,147,256, issued to Howard Silagy, on Sep. 15, 1992. Again, no pincer grasp therapy of any sort is suggested in this patent.

U.S. Pat. No. 5,156,581, issued to John W. Chow, on Oct. 20, 1992, discloses a finger exerciser against variable weights, the finger exercises including flexion and extension, principally; no provision for pincer grasp therapy is taught by the Chow patent.

A finger and thumb exercising device employing rollers moved by the fingers is seen in U.S. Pat. No. 5,299,991, issued to Atuhiko Sato, on Apr. 5, 1994. Again, no provision is made for pincer grasp therapy.

Additional hand squeezing apparatuses or devices not including any provision for pincer grasp therapy are disclosed in U.S. Pat. Nos. 5,445,582, issued to Gary L. Brown, on Aug. 29, 1995, and 5,451,191, issued to Gregory M. Beenken on Sep. 19, 1995, and 5,527,240, issued to Chun N. Chen, on Jun. 18, 1996; the Chen patent teaches compressed air created by squeezing the device as the counter force in the exerciser.

A glove permitting flexion/extension exercising of the fingers but, again, making no provision for pincer grasp therapy, is taught in U.S. Pat. No. 5,527,244, issued to John F. Waller, on Jun. 18, 1996.

None of the above inventions and patents, taken either singularly or in combination, is seen to describe the instant invention as claimed. Thus a pincer grasp therapy device solving the aforementioned problems is desired.

SUMMARY OF THE INVENTION

A pincer grasp therapy device, according to the present invention, comprises a board having a groove with compartmentalizing walls and a plurality of grasping pieces in the groove. The groove is deep enough to require careful alignment of fingers used to grasp the grasping pieces in the groove. In this way, development of pincer grasping maneuver is practiced and improved. Parts are dimensioned and configured in a range varying from quite small to large, to accommodate the finger and hand sizes of users ranging from small children to adults. Also, the relative sizes of pieces to board and groove size can be varied widely, from small groove/large pieces to large groove/small pieces, thus to provide a very wide range of occupational therapy exercises.

Accordingly, it is a principal object of the invention to provide a therapy device for developing pincer grasping maneuvers.

It is another object of the invention to provide alternately initial and advanced therapy modes.

It is a further object of the invention to provide immobilization of a therapy device to improve functionality of a therapy device.

It is yet another object of the invention to provide a therapy device for developing pincer grasping maneuvers which can be provided in a wide variety of sizes so as to accommodate users ranging from small children to adults.

It is an object of the invention to provide improved elements and arrangements thereof in a pincer grasp therapy device for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
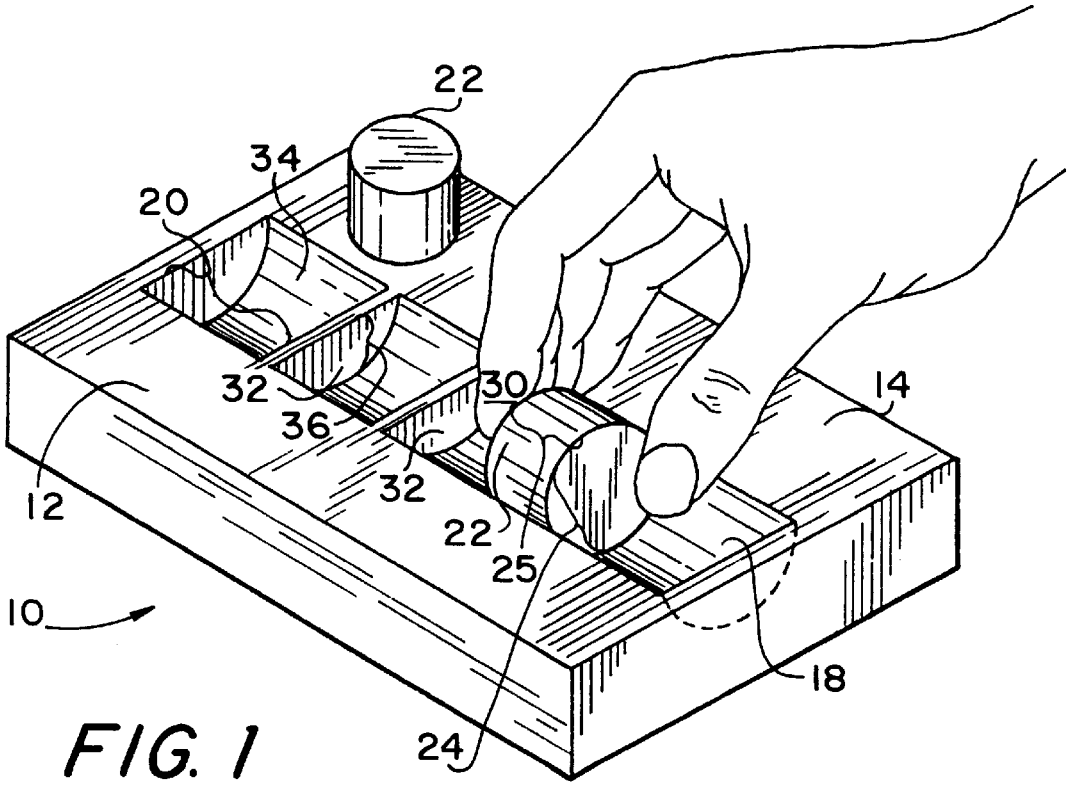
FIG. 1 is an environmental, top perspective view of a first embodiment of the present invention, showing grasping pieces in place within an arcuate groove.

The present invention, a pincer grasp therapy device, is designed to provide a flat board or platform for refined therapeutic pinching of items placed in compartments of a groove in the board. The groove is sufficiently deep that the user is required to position the hand correctly in order to reach the items in the groove. An easy-to-use version of the invention includes a rounded groove with relatively large items to be placed in, and removed from, the groove. A more difficult version of the invention includes a flat groove with smaller, flat items to be placed in, and removed from, the groove. In either version, the board may be attached to a surface and made stationary by such means as suction cups, for example, thereby allowing unassisted use.

Referring to the drawings, a pincer grasp therapy device 10, according to the present invention, comprises a flat board 12 having a front face 14 and a rear face 16, a groove 18 or multiple grooves (not shown) in the front face 14 of the board 12, the groove 18 having a width 20, and a plurality of grasping pieces 22, 23, each having a height 24 and a length 25 and being dimensioned and configured to selectively be inserted into and removed from the groove 18. Each grasping piece dimensioned for grasping between the thumb and fingers of the user.

In a first embodiment of the therapy device 10, and as illustrated in FIG. 1, the groove 18 has an arcuate cross-section and arcuate grasping pieces 22 that are large relative to a typical user's finger-tips 30. This embodiment of the therapy device 10 provides beginning or initial pincer grasp therapy, as when a user has severe hand dysfunction.

Figure 2:
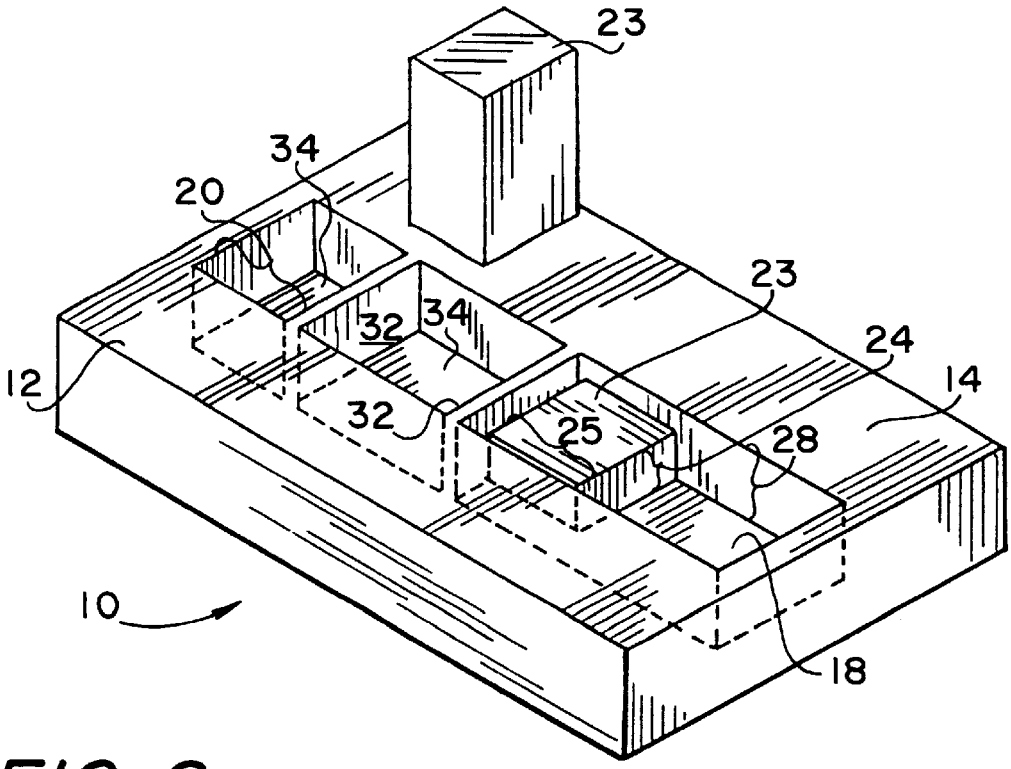
FIG. 2 is an environmental, top perspective view of a second embodiment of the present invention, showing grasping pieces in place within a square-cornered groove.
Figure 3:
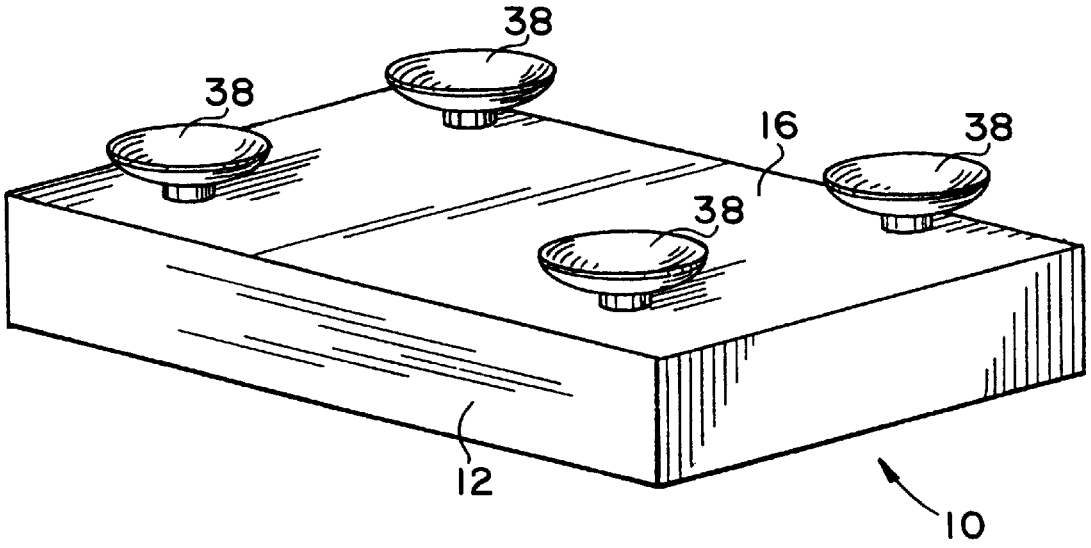
FIG. 3 is a bottom perspective view of the present invention when a flat board is used, showing immobilizing suction cups.

In a second embodiment of the therapy device 10, depicted in FIG. 2, the groove 18 has a square-cornered cross-section and square-cornered grasping pieces 23 that are small relative to a typical user's finger-tips 30. This embodiment of the therapy device 10 provides advanced pincer grasp therapy, as when a user has only moderate hand dysfunction.

The groove 18 of the pincer grasp therapy device 10 preferably has a width 20 dimensioned and configured to allow insertion of fingers 30 of a hand into the groove 18, in addition to the grasping pieces 22, 23. In both the first embodiment and the second embodiment, the pincer grasp therapy device 10 preferably has a large depth 28 (see FIG. 2; not shown in FIG. 1) that is greater than the height 24 of the grasping pieces. In this way, a user of the therapy device 10 must align fingers 30 of the user's hand with the groove 18 in order to reach into the groove 18 to grasp the grasping pieces 22, 23. This necessity for alignment of the fingers 30 adds to the therapeutic effect of the device 10. Moreover, there are preferably walls 32 disposed in the groove 18, defining or forming compartments 34 in the groove 18. For easier reaching and grasping of the grasping pieces 22, 23, the groove 18 may have a shallow depth 36 (see FIG. 1; not shown in FIG. 2), less than the height 24 of the grasping pieces 22, 23. The latter depth 36 would be especially appropriate for use with the first, easier-to-use embodiment of the pincer grasp therapy device 10.

It must be noted here that the relative size of the pieces 22, 23 with respect to the width and depth of the groove 18 may be varied, often considerably, to accommodate a wide range of hand and finger sizes, ranging from small child to adult. Also, the pieces may be made larger and the groove smaller, or vice versa.

The therapy device has structure for attaching the board 12 to a surface, such as a table. Preferably, this structure is made up of a plurality of suction cups 38 disposed on the rear or bottom face 16 of the board 12, although other known attachment structure could be provided. In use, the therapy device 10 is attached to a surface using the suction cups 38, and then the grasping pieces 22, 23, are placed into, or removed from the groove 18 in the flat board 12, thereby providing therapy to a user's hands and developing pincer grasp function in a user's fingers.

Figure 4:
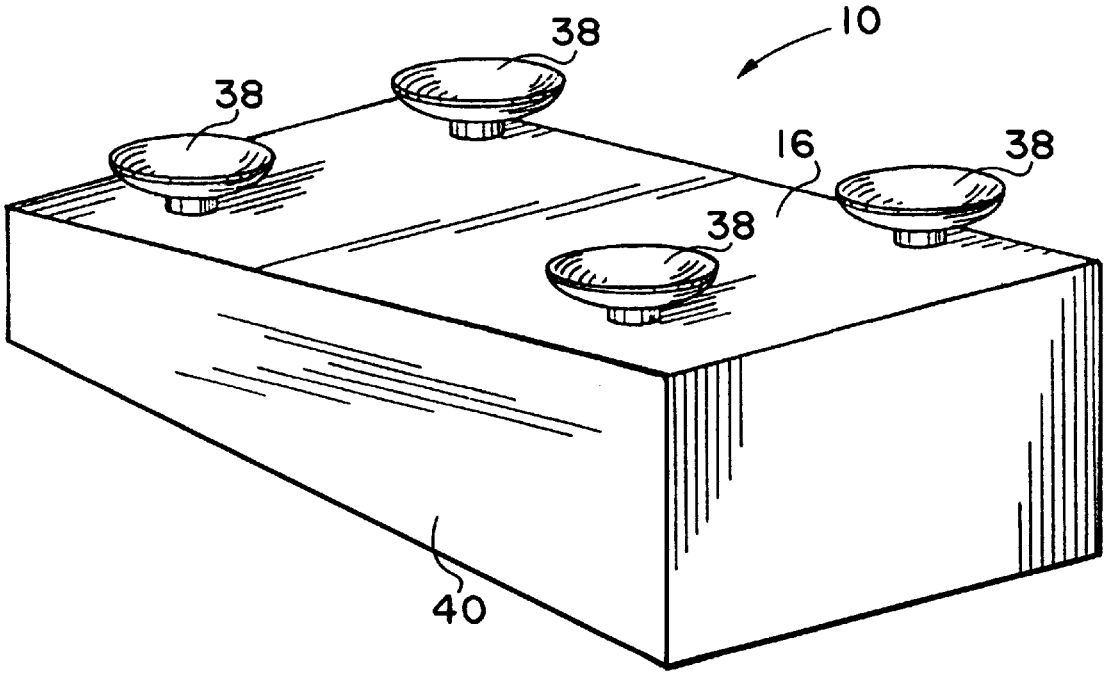
FIG. 4 is a bottom perspective view of the present invention when a wedge-shaped board is used, also showing immobilizing suction cups.

In either embodiment, complexity of the pincing (pinching) function can be increased by varying the structure of the board. In particular, a wedge-shaped board 40 can be employed in place of the flat board 12, as shown in FIG. 4. In all respects other than shape, the wedge-shaped board 40 is identical to the flat board 12. Thus, when suction cups 38 attached to a rear face 16 of the wedge-shaped board 40, the groove 18 is inclined relative to a surface on which the therapy device 10 is placed.

It is to be understood that the present invention is not limited to the embodiments described above, but encompasses any and all embodiments within the scope of the following claims.

I claim:

1. A pincer grasp therapy apparatus, comprising:

a plurality of grasping pieces, each having a height and a length;

a flat board having a groove, said groove having a depth sufficient to accept at least a portion of said height of each of said plurality of grasping pieces, wherein said groove is elongated and further includes walls disposed in said groove, thus to define compartments formed in said groove, each of said compartments having a different width for varying skill level;

whereby one of said plurality of grasping pieces is selectively inserted into and removed from said groove through exercise of a pincer grasp.

2. The pincer grasp therapy apparatus according to claim 1, wherein said groove has an arcuate cross-section.

3. The pincer grasp therapy apparatus according to claim 1, wherein said grasping pieces each have an arcuate cross-section.

4. The pincer grasp therapy apparatus according to claim 1, wherein said groove and said grasping pieces each have an arcuate cross-section.

5. The pincer grasp therapy apparatus according to claim 1, wherein said groove has a square-cornered cross-section.

6. The pincer grasp therapy apparatus according to claim 1, wherein said grasping pieces each have a square-cornered cross-section.

7. The pincer grasp therapy apparatus according to claim 1, wherein said groove and said grasping pieces each have a square-cornered cross-section.

8. The pincer grasp therapy apparatus according to claim 1, wherein said depth of said groove is greater than said height of at least one of said grasping pieces.

9. The pincer grasp therapy apparatus according to claim 1, further including means for attaching said board to a surface.

10. The pincer grasp therapy apparatus according to claim 9, wherein said means for attaching said board are a plurality of suction cups.

11. A pincer grasp therapy apparatus, comprising:

a plurality of grasping pieces, each having a height and a width, said grasping pieces having a cross-section shape selected from the group consisting of arcuate and square-cornered shapes;

a wedge-shaped board having a groove, said groove having a depth sufficient to accept at least a portion of said height of each of said plurality of grasping pieces, wherein said groove is elongated and further includes walls disposed in said groove, thus to define compartments formed in said groove, each of said compartments having a different width for varying skill level;

means for attaching said board to a surface;

whereby one of said plurality of grasping pieces is selectively inserted into and removed from said groove through exercise of a pincer grasp.

12. The pincer grasp therapy apparatus according to claim 11, wherein said depth of said groove is greater than said height of at least one of said grasping pieces.

13. The pincer grasp therapy device according to claim 11, wherein said means for attaching said board are a plurality of suction cups disposed on said rear face of said board.

* * * * *